US005759977A

United States Patent [19]

van den Brom et al.

[11] Patent Number: 5,759,977

[45] Date of Patent: Jun. 2, 1998

[54] SOLID DETERGENT BLOCK

[75] Inventors: Guido Clemens van den Brom; Hendrik Johannes Connotte, both of Maarssen, Netherlands

[73] Assignee: Diversey Lever, Inc., Plymouth, Mich.

[21] Appl. No.: 745,143

[22] Filed: Nov. 7, 1996

[30] Foreign Application Priority Data

Nov. 13, 1995 [EP] European Pat. Off. ..... 95203081

[51] Int. Cl.[6] ..... C11D 1/825; C11D 17/00

[52] U.S. Cl. ..... 510/224; 510/446

[58] Field of Search ..... 510/224, 446, 510/451

[56] References Cited

U.S. PATENT DOCUMENTS

| | | | |
|---|---|---|---|
| 2,371,720 | 3/1945 | Stine | 299/83 |
| 2,382,163 | 8/1945 | MacMahon | 252/138 |
| 2,382,164 | 8/1945 | MacMahon | 252/138 |
| 2,382,165 | 8/1945 | MacMahon | 252/135 |
| 4,219,435 | 8/1980 | Biard et al. | 252/90 |
| 4,808,236 | 2/1989 | Davis, Jr. | 134/25.2 |
| 4,897,212 | 1/1990 | Kruse et al. | 252/99 |
| 4,911,860 | 3/1990 | van den Brom | 252/174.21 |
| 4,913,832 | 4/1990 | Kruse et al. | 252/99 |
| 4,915,865 | 4/1990 | Westermann et al. | 252/157 |
| 5,316,688 | 5/1994 | Gladfelter et al. | 252/90 |
| 5,366,706 | 11/1994 | Perry, Jr. et al. | 422/266 |
| 5,474,698 | 12/1995 | Rolando et al. | 252/90 |
| 5,518,646 | 5/1996 | Van Den Brom | 252/174 |
| 5,578,136 | 11/1996 | Taylor et al. | 139/25.2 |
| 5,624,892 | 4/1997 | Angevaare et al. | 510/223 |
| 5,663,133 | 9/1997 | Goldstein | 510/224 |
| 5,695,575 | 12/1997 | Angevaare et al. | 134/25.2 |
| 5,705,465 | 1/1998 | Angevaare et al. | 510/220 |

FOREIGN PATENT DOCUMENTS

| | | |
|---|---|---|
| 244 153 | 11/1987 | European Pat. Off. . |
| 003 769 | 9/1989 | European Pat. Off. . |
| 375 022 | 6/1990 | European Pat. Off. . |
| 42 29 650 | 1/1994 | Germany . |

*Primary Examiner*—Paul Lieberman
*Assistant Examiner*—John R. Hardee
*Attorney, Agent, or Firm*—A. Kate Huffman

[57] ABSTRACT

A solid detergent composition suitable for use in an industrial warewashing process and in the form of a block of compressed granular material is provided, said block having a weight of 0.2-10 kg and comprising:

25–35% by weight of an alkalimetal metasilicate selected from sodium- and potassium metasilicate;

40–55% by weight of a phosphate builder;

2–4% by weight of a compressing aid selected from low foaming nonionic surfactants, metal soaps, paraffins, talcum powder, polyethylene glycol, sodium benzoate, mixtures of long chain ketones having more than 25 carbon atoms and fatty alcohols, and mixtures thereof; and up to 7.0% by weight of free water. Said block has optimal quality characteristics.

10 Claims, No Drawings

SOLID DETERGENT BLOCK

FIELD OF THE INVENTION

The present invention relates to a solid detergent block for obtaining an aqueous chemical solution having a substantially constant concentration. The invention also relates to a process for preparing such a block. Such detergent blocks are suitable for use in an industrial cleaning process, particularly a mechanical warewashing process, and generally comprise alkaline agents and detergency builders.

BACKGROUND OF THE INVENTION

Industrial warewashing machines generally comprise a wash tank which contains the cleaning solution for the wash process. In this process, the soiled wash load is doused with the cleaning solution and subsequently with rinse water which falls into the wash tank. Each cycle, the cleaning power of the cleaning liquor is reduced, first because some is exhausted by the soil-removing process and, secondly, because it is diluted with rinse water. The cleaning solution is therefore recharged from time to time by adding fresh cleaning product from a dispenser system, which usually provides liquid product or a concentrated aqueous solution of a composition including solid chemicals.

A number of techniques are known for converting solid chemicals into a concentrated aqueous solution, dependent on the nature of the solid. For example, according to U.S. Pat. No. 2,371,720 a solid powdered chemical can be dissolved by placing it on a sieve and spraying water on to said sieve from below.

Alternatively, the powdered material can be dissolved in a dispenser of the "water-in-reservoir" type. In this type of dispenser, the powdered material is submerged under water, which therefore becomes loaded or even saturated with the powder. When more water is added, the excess solution flows into an overflow pipe leading to the washing machine.

It is also possible to use solid detergent materials in the form of briquettes such as, for instance, described in U.S. Pat. Nos. 2,382,163, 2,382,164 and 2,382, 165. Brquettes can be used with a "water-in-reservoir" type of dispenser.

A well-known type of solid detergent is the cast block form, whereby a solid detergent block having a weight of several kilograms is formed by pouring a concentrated aqueous slurry into a container, in which it solidifies upon cooling as a result of the hydration of the salts in the composition. Such cast solid blocks are, for example, described in European patent 3,769.

These solid blocks cast in containers require dispensing systems whereby water is sprayed onto the block while it is inside the container, thereby gradually dissolving the exposed surface to form a concentrated solution. Such a dispenser system is, for instance described in European patent application 244,153.

Solid detergent blocks have won a certain degree of popularity in the area of industrial warewashing because they constitute a non-dusty and therefore relatively safe product form for the often aggressive chemicals used. Furthermore, hydrated solid blocks are economical in use because they can be manufactured and transported as concentrated products. However, elevated temperatures are required in the manufacturing process of these hydrated solid detergent blocks and these temperatures have an adverse effect on the stability of heat-labile components of the blocks.

In EP-A-375,022, an alternative type of detergent block is disclosed, namely a block of compressed granular material.

This block constitutes an even more concentrated product and enables the incorporation of heat-labile components such as bleach compounds.

However, we have found that the quality of these compressed detergent blocks often leaves to be desired when considerable levels of hygroscopic materials are applied therein.

We have now surprisingly found that optimal quality of compressed detergent blocks can be realised when detergent blocks having a composition according to the present invention are prepared. More in particular, we have found that rather specific compositions including a compressing aid and having controlled free water level are essential for obtaining optimal quality of the detergent block. In the context of the present invention, a good quality block is defined as a block having a bulk density of 1200–2100 kg/m$^3$, preferably 1700–2000 kg/m$^3$, and showing neither cracks in the block (lamination) nor at the top or bottom surface of the block (capping).

DEFINITION OF THE INVENTION

Accordingly, in a first aspect the present invention provides a solid detergent composition suitable for use in an industrial warewashing process and in the form of a block of compressed granular material, said block having a weight of 0.2–10 kg and comprising:

- 25–35% by weight of an alkalimetal metasilicate selected from sodium- and potassium metasilicate;
- 40–55% by weight of a phosphate builder;
- 2–4% by weight of a compressing aid selected from low foaming nonionic surfactants, metal soaps, paraffins, talcum powder, polyethylene glycol, sodium benzoate, mixtures of ion chain ketones having more tha 25 carbon atoms and fatty alcohols, and mixtures thereof; and
- up to 7.0% by weight of free water.

Preferably, the detergent block according to the present invention has a weight of 1–5 kg.

In a second aspect, the present invention provides a process for manufacturing a solid detergent block of the invention, whereby a powder having a corresponding composition is compressed in a mould under a pressure of 3–30 kN/cm$^2$ to form a solid block.

A third aspect of the present invention is the use of a solid detergent block according to the invention in an industrial warewashing process.

DETAILED DESCRIPTION OF THE INVENTION

The solid detergent blocks of the invention generally contain detergent components usually found in detergent material suitable for use in a machine warewashing process. As shown above, these components comprise an alkalimetal metasilicate, a phosphate builder, and one or more types of compressing aid.

It is essential that the free water content of the detergent blocks is below 7.0% by weight in order to obtain good quality blocks. A free water content above this level was found to result in lamination and capping phenomena, and/or in considerable block expansion by which the lifetime and the density of the block is dramatically reduced. A high block density of at least 1700 kg/m$^3$ is preferred since transport cost and amount of packaging material are generally reduced with blocks of higher density.

Control of the free water level during manufacture of the detergent blocks of the invention was found to be essential to obtain good quality blocks. Preferably, the free water level of the detergent blocks is below 6.5% by weight. In the context of the present invention, free water level is defined as the weight loss observed when heating the granular material used for producing the block concerned, during 4 hours at a temperature of 130° C.

Alkalimetal metasilicate

In the blocks of the present invention a considerable amount of alkalimetal metasilicate is used, as an alkaline agent. The preferred type of alkali metal metasilicate is sodium metasilicate.

It was found that articles containing parts made of soft metals such as aluminium, copper and brass, for instance pots and pans, are not adversely affected when washed with a detergent block of the present invention. On the other hand, when these articles were washed with similar detergent blocks in which the alkalimetal metasilicate is replaced by an equal level of sodium hydroxide, these articles were observed to be negatively affected to a large extent. For instance, discolouration, such as blackening of aluminium surfaces, and corrosion phenomena, such as dissolution of $Al_2O_3$-layers on aluminium surfaces, were found.

It was also found that blocks of the present invention provide a wash liquor with sufficiently high alkalinity, e.g. having a pH of 10–12, to ensure optimal cleaning performance of normally soiled wash loads. In view of the negative affects resulting from washing with detergent blocks containing alkalimetal hydroxide, detergent blocks which are substantially free of alkalimetal hydroxide are preferred. These preferred detergent blocks are defined to be blocks containing at most 5% by weight of alkali metal hydroxide. In addition to alkalimetal metasilicate, the blocks of the invention may contain up to 20% by weight of other types of alkaline agent, preferably sodium- or potassium carbonate.

Phosphate builder

Generally, the detergent blocks of the invention contain 40–55% by weight of phosphate builder. The combination of the alkalimetal metasilicate and this relatively high concentration range of phosphate builder makes the blocks suitable for use in machine ware washing processes in which moderately to severely soiled articles containing parts made of soft metals are cleaned. Furthermore, better safety for the user is ensured whith blocks of the present invention, than when applying detergent blocks containing major levels of caustic.

The phosphate builder material present in the blocks of the invention is generally defined to be phosphate containing material which is capable of reducing the level of free calcium and magnesium ions in the wash liquor, and, preferably, provides the composition with other beneficial properties such as the generation of an alkaline pH and the suspension of soil removed from the substrate to be removed. Preferred phophate builders are pyrophosphate, orthophosphate and tripolyphosphate. Sodium tripolyphosphate is most preferred.

Compressing aid

The compressing aid present in the blocks of the invention is selected from low foaming nonionic surfactants, metal soaps, paraffins, talcum powder, polyethylene glycol, sodium benzoate, mixtures of long chain ketones having more than 25 carbon atoms and fatty alcohols, and mixtures thereof.

This compressing aid is an essential ingredient of the detergent block of the invention since it is needed during the compaction process for obtaining strong blocks of good quality. However, only moderate levels of compressing aid, being in the range of 2–4% by weight, are required since levels above said range would result in weaker blocks.

Preferred compressing aids are low foaming nonionic surfactants and mixtures of long chaing ketones having more than 25 carbon atoms and fatty alcohols, since such materials are highly effective both as a lubricant during the manufacturing process of the block and as an anti-foaming agent when using the block in a machine warewashing process.

Preferred types of low foaming nonionic surfactants are $C_8$–$C_{20}$ alkoxylated fatty alcohols. When mixtures of long chain ketones and fatty alcohols are used, these mixtures are preferably in the form of a dispersion of the long chain ketone in the liquid-form fatty alcohol which is preferably a branched fatty alcohol having 8 to 24 carbon atoms. Such compositions are commercially available, for instance from Henkel as Dehypon 2429.

Bleaching agent

The detergent block of the invention may also comprise a bleach component, encapsulated or not, in an amount of up to 20% by weight. Said bleach component may be a hypohalite bleach such as NaDCCA, or a peroxygen compound, i.e. a compound capable of yielding hydrogen peroxide in aqueous solution.

For environmental reasons, a peroxygen compound selected from alkali metal peroxides, organix peroxides, such as urea peroxide, and inorganic persalts such as the alkali metal perborates, percarbonates, perphosphates, persilicates and persulphates, is preferably used. Mixtures of two or more of such compounds may also be suitable.

Particularly preferred are sodium perborate tetrahydrate and, especially, sodium perborate monohydrate. Sodium perborate monohydrate is preferred because of its high active oxygen content. Sodium percarbonate may also be preferred for environmental reasons.

The peroxygen bleach compound is suitably present in the detergent block of the invention at a level of up to 20% by weight, preferably of from 5 to 10% by weight.

On the other hand, the hypohalite bleach, if present, may be suitably used in an amount of up to 5%, preferably 1–4% by weight, as active chlorine.

Organic peroxyacids may also be suitable as peroxygen bleaching agent. Such materials normally have the general formula:

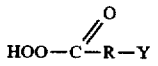

wherein R is an alkylene or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a COOH or

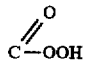

group or a quaternary ammonium group.

Typical monoperoxy acids useful herein include, for example:

(i) peroxybenzoic acid and ring-substituted peroxybenzoic acids, e.g. peroxy-α-naphthoic acid;

(ii) aliphatic, substituted aliphatic and arylalkyl monoperoxyacids, e.g. peroxylauric acid, peroxystearic acid and N,N-phthaloylaminoperoxy caproic acid (PAP); and (iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxybrassilic acid; diperoxysebasic acid and diperoxyisophthalic acid;

(vii) 2-decyldiperoxybutane-1,4-diotic acid; and (viii) 4,4'-sulphonylbisperoxybenzoic acid.

Also inorganic peroxyacid compounds are suitable, such as for example potassium monopersulphate (MPS). If organic or inorganic peroxyacids are used as the peroxygen compound, the amount thereof will normally be within the range of about 2–10% by weight, preferably from 4–8% by weight.

All these peroxide compounds may be utilized alone or in conjunction with a peroxyacid bleach precursor and/or an organic bleach catalyst not containing a transition metal.

Peroxyacid bleach precursors are known and amply described in literature, such as in the British Patents 836988; 864,798; 907,356; 1,003,310 and 1,519,351; German Patent 3,337,921; EP-A-0185522; EP-A-0174132; EP-A-0120591; and U.S. Pat. Nos. 1,246,339; 3,332,882; 4,128,494; 4,412,934 and 4,675,393.

Another useful class of peroxyacid bleach precursors is that of the cationic i.e. quaternary ammonium substituted peroxyacid precursors as disclosed in U.S. Pat. No. 4,751,015 and 4,397,757, in EP-A0284292 and EP-A-331,229. Examples of peroxyacid bleach precursors of this class are:

2-(N,N,N-trimethyl ammonium) ethyl sodium-4-sulphonphenyl carbonate chloride - (SPCC);

N-octyl,N,N-dimehyl-$N_{10}$-carbophenoxy decyl ammonium chloride - (ODC);

3-(N,N,N-trimethyl ammonium) propyl sodium-4-sulphophenyl carboxylate; and

N,N,N-trimethyl ammonium toluyloxy benzene sulphonate.

A further special class of bleach precursors is formed by the cationic nitriles as disclosed in EP-A-303,520 and in European Patent Specification No.'s 458,396 and 464,880.

Any one of these peroxyacid bleach precursors can be used in the present invention, though some may be more preferred than others.

Of the above classes of bleach precursors, the preferred classes are the esters, including acyl phenol sulphonates and acyl alkyl phenol sulphonates; the acyl-amides; and the quaternary ammonium substituted peroxyacid precursors including the cationic nitriles.

Examples of said preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoloxy benzoate; SPCC; trimethyl ammonium toluyloxy-benzene sulphonate; sodium nonanoyloxybenzene sulphonate (SNOBS); sodium 3,5,5-trimethyl hexanoyloxybenzene sulphonate (STHOBS); and the substituted cationic nitriles.

The precursors may be used in an amount of up to 12%, preferably from 2–10 % by weight, of the composition. Organic bleach catalyst most suitable for being utilized here are the so-called sulphonimides as disclosed in EP-A-0453003 and EP-A-0446982.

Other ingredients

The detergent block of the invention preferably also comprises 0–10% by weight of a polycarboxylated polymer. Suitable polymers are for instance polyacrylates such as Norasol LMW45D, ex Norsohaas.

However, a polycarboxylate polymer on a suitable carrier material, for instance a polyacrylate polymer on a carbonate and/or silicate carrier, such as Norasol WL2-Si, ex NorsoHaas, is more preferred. Reason is that the presence of this type of polymer on carrier in the detergent block, desirably at a level up to 25% by weight, results in a higher density and improved stability of the block.

The detergent block of the invention may further comprise suitable minor ingredients, such as bleach stabilizers, enzymes, etc.

Process

During manufacture of the detergent block of the invention, it is preferred that all solid starting materials should be dry and (in the case of hydratable salts) in a low hydration state. For instance, anhydrous phosphate builder is preferably used as constituent of the detergent block.

According to the process of the invention, a suitable granular detergent powder corresponding to the desired chemical composition is formed and subsequently compressed in a mould under a pressure of 3–30 kN/cm$^2$. Preferably, all constituents of the detergent block are homogeneously distributed through the powder before compression of said powder is carried out.

This process can be carried out in any suitable press, preferably a hydraulic press containing two movable punches, for instance a LAEIS Hydraulische Doppeldruckpresse, TYP HPF 630 as manufactured by LAEIS, West Germany.

In order to obtain good quality blocks having a sufficiently low free water content, the relative humidity of the air that is in contact with the powder to be compacted during the manufacturing process, is preferably kept below 35%, more preferably below 10% .

Preheating of the powder to be compacted or heating of the punches of the hydraulic press, generally results in reduced stickyness of said powder, which in turn leads to less wall friction of the detergent block in the mould, and, consequently, a reduced risk of damage when ejecting said block out of the mould. However, for safety reasons (in order to avoid any risk of self-heating due to exothermic reactions) the powder temperature is preferably kept below 40° C., more preferably below 35° C.

Since the compaction is carried out at such moderate temperatures, considerable levels of heat sensitive components, such as bleach compounds or enzymes, may be incorporated in the detergent block of the invention. This is regarded as an additional advantage of this manufacturing process.

In order to minimize the risk of the occurrence of capping phenomena caused by air expansion, a deaeration step is preferably applied during the compaction process. After manufacture, the detergent block of the invention is desirably packaged as soon as possible, owing to its hygroscopic nature.

Use

Another aspect of the invention is the use of the solid detergent block of the invention in an industrial warewashing process wherein articles containing parts made of soft metals are washed.

In use, the detergent block may be placed inside a suitable dispenser, in which it is sprayed upon with water in order to obtain an aqueous solution of the sold detergent material. Depending on the nature of the solid detergent block of the invention, the water may also form a slurry or suspension of the chemical material contained therein.

The invention is further illustrated by the following non-limiting Examples, in which parts and percentages are by weight unless otherwise stated.

In the Examples, the following abbreviations are used:

Thermphos NW: sodium tripolyphophate, ex Hoechst;

Dehypon 2429: mixture of ketones in fatty alcohol, ex Henkel;

Plurafac LF403: fatty alcohol with ethylene oxide and propylene oxide groups, ex BASF;

Dequest 2047: calcium salt of ethylene diamine tetra methylene phosphonic acid, ex Monsanto;

Norasol WL2-Si: 40% polyacrylate (mol wt 4500) on 30% sodium silicate ($SiO_2$:$Na_2O$=2) and 30% sodium carbonate, ex NorsoHaas.

Example 1

Comparative Example A

Homogeneous powder-form mixtures having the following compositions were obtained by mixing the components in a Lodige-type mixer:

| Example no. | 1 (%) | A (%) |
|---|---|---|
| Thermphos NW | 50.0 | 50.0 |
| Dehypon 2429 | 2.0 | 2.0 |
| Plurafac LF403 | 2.0 | 2.0 |
| Norasol WL2-Si | 2.5 | 2.5 |
| Na metasilicate anhydrous | 29.0 | 29.0 |
| Dequest 2047 | 0.5 | 0.5 |
| Na Percarbonate | 12.5 | 12.5 |
| Mg trisilicate | 1.0 | 1.0 |
| Mg stearate | 0.2 | 0.2 |
| Ca behenate | 0.3 | 0.3 |

The free water content of the resulting powder was measured to be 6.5% by weight (for the mixture of Example 1) respectively 7.5% by weight (for the mixture of Example A). This difference in free water content is caused by different environmental conditions, in particular different relative humidities of the air in contact with the respective powders.

In both cases, the resulting powder was compressed to 3 kg blocks in a mould under a pressure of 14 kN/cm$^2$ using a double punch press. During this compaction process, the temperature and relative humidity of the air that was in contact with the powder to be compacted, were respectively 22° C. and 10%.

As a result blocks were obtained having following quality characteristics:

| Examples | 1 | A |
|---|---|---|
| block density (kg/m$^3$) | 1830 | 1830 |
| appearance of block | strong | strong |
| lamination | no | no |
| capping | no | yes |
| cracks | no | yes |

It can be concluded that the block according to the invention has a significantly better quality than the block of the comparative Example having a free water content just in excess of 7.0% by weight.

We claim:

1. Solid detergent composition suitable for use in an industrial warewashing process and in the form of a block of compressed granular material, said block comprising:

25–35% by weight of an alkali metal metasilicate selected from sodium- and potassium metasilicate;

40–55% by weight of a phosphate builder;

2–4% by weight of mixtures of long chain ketones having more than 25 carbon atoms and fatty alcohols; and up to 7.0% by weight of free water defined as weight loss observed when heating the block for four hours at a temperature of 130° C., the block having a weight of 1–5 kg.

2. Solid detergent composition according to claim 1, said composition being substantially free of alkalimetal hydroxide.

3. Solid detergent composition according to claim 1, wherein the phosphate builder is sodium tripolyphosphate.

4. Solid detergent composition according to claim 1, comprising up to 6.5% by weight of free water.

5. Solid detergent composition according to claim 1, additionally comprising up to 20% by weight of a bleaching agent.

6. Solid detergent composition according to claim 5, wherein said bleaching agent is selected from sodium perborate and sodium percarbonate.

7. Process for the manufacture of a solid detergent composition according to claim 1, whereby a powder having a corresponding composition is compressed in a mould under a pressure of 3–30 kN/cm$^2$ to form a solid block.

8. Process according to claim 7, whereby during said process the relative humidity of the air that is in contact with the powder to be compacted, is below 35%.

9. Process according to claim 7, whereby during said process the temperature of the air that is in contact with the powder to be compacted, is below 40° C.

10. Use of a solid detergent composition according to claim 1, in an industrial warewashing process.

* * * * *